US010279323B2

(12) United States Patent
McKenna et al.

(10) Patent No.: US 10,279,323 B2
(45) Date of Patent: May 7, 2019

(54) SHUTTLING VENTURI

(71) Applicant: Infuze, L.L.C., Wellsville, UT (US)

(72) Inventors: Shane McKenna, Salt Lake City, UT (US); Daniel Noall, Wellsville, UT (US)

(73) Assignee: Infuze, L.L.C., Wellsville, UT (US)

( * ) Notice: Subject to any disclaimer, the term of this patent is extended or adjusted under 35 U.S.C. 154(b) by 313 days.

(21) Appl. No.: 14/989,471

(22) Filed: Jan. 6, 2016

(65) Prior Publication Data

US 2016/0296900 A1 Oct. 13, 2016

Related U.S. Application Data

(60) Provisional application No. 62/145,811, filed on Apr. 10, 2015.

(51) Int. Cl.
*B01F 5/04* (2006.01)

(52) U.S. Cl.
CPC ..... *B01F 5/0496* (2013.01); *B01F 5/0428* (2013.01); *B01F 2005/044* (2013.01); *B01F 2215/0022* (2013.01)

(58) Field of Classification Search
CPC ..... B01F 5/0428; B01F 5/0413; B01F 2005/044; B01F 2215/0022; B01F 5/0496; F04F 5/461
USPC ..... 251/205; 137/625.39; 239/579; 366/163.1, 163.2
See application file for complete search history.

(56) References Cited

U.S. PATENT DOCUMENTS 285,822 A * 10/1883 Korting ..... B01F 5/0428 261/76
330,157 A * 11/1885 Shutte ..... B01F 5/0428 261/76
344,502 A * 6/1886 Shutte ..... B01F 5/0428 261/76
387,261 A * 8/1888 Shutte ..... B01F 5/0428 261/76
393,488 A * 11/1888 Shutte ..... B01F 5/0428 261/76
427,193 A * 5/1890 Shutte ..... B01F 5/0428 159/1.1
1,831,439 A * 11/1931 Carter ..... F02M 3/12 261/41.5
2,188,463 A * 1/1940 Mercier ..... F04B 49/035 137/115.2
2,575,810 A * 11/1951 Hirst ..... F16K 11/065 137/599.13
2,769,610 A * 11/1956 Franzheim ..... F16K 3/26 137/625.39
2,913,232 A * 11/1959 Silverman ..... B01D 47/10 239/380
2,946,193 A * 7/1960 Chittenden ..... F16H 61/423 60/389
3,380,393 A * 4/1968 Nielsen ..... F04F 5/461 417/190

(Continued)

*Primary Examiner* — Tony G Soohoo
(74) *Attorney, Agent, or Firm* — Durham Jones & Pinegar, P.C., Intellectual Property Law Group

(57) ABSTRACT

A shuttling Venturi that eliminates the need for a check valve to prevent backflow or an on/off valve to control flow of a secondary fluid. The shuttling Venturi provides for the mixing of liquids, gases and/or solids, in particular, in applications where space is limited and extra control valves cannot be located.

12 Claims, 5 Drawing Sheets

(56) References Cited

U.S. PATENT DOCUMENTS

| | | | | | |
|---|---|---|---|---|---|
| 4,411,389 | A * | 10/1983 | Harrison | B05B 7/149 | 222/145.1 |
| 5,311,905 | A * | 5/1994 | De Santis | B08B 3/026 | 137/115.06 |
| 5,626,291 | A * | 5/1997 | Flinn | B01F 5/0413 | 239/310 |
| 5,758,691 | A * | 6/1998 | Nedderman, Jr. | B01F 5/0413 | 137/893 |
| 6,343,594 | B1 * | 2/2002 | Koeslin | F02M 26/19 | 123/568.11 |
| 8,596,417 | B2 * | 12/2013 | Barrett | F02C 7/06 | 184/6.11 |
| 2004/0079411 | A1 * | 4/2004 | Davis | B08B 3/026 | 137/115.16 |
| 2013/0193226 | A1 * | 8/2013 | Uschold | B01F 5/0413 | 239/10 |
| 2016/0296900 | A1 * | 10/2016 | McKenna | B01F 5/0428 | |

* cited by examiner

SHUTTLING VENTURI

CROSS REFERENCE TO RELATED APPLICATION

This application claims the benefit of U.S. Provisional Application Ser. No. 62/145,811 filed Apr. 10, 2015 by Daniel Kenneth Noall.

FIELD OF THE INVENTION

The present invention relates generally to a Venturi and more particularly to a shuttling Venturi that can be used for mixing liquids, gases or solids.

BACKGROUND OF THE INVENTION

When a fluid flows through a restricted area, the fluid pressure is reduced, and the fluid velocity is increased. This is known as a Venturi effect. It is known in the art that a Venturi can be used to mix liquids, gases and/or solids. In mixing liquids, a Venturi utilizes the kinetic energy of one liquid to cause another liquid to flow and usually consists of a converging nozzle, a chamber body, and a diffuser. When the primary fluid enters the converging nozzle, the pressure is decreased and acts to pull a secondary fluid into the flow of the fluid going through the nozzle, mixing the two fluids together.

One problem that is universally faced in using a Venturi for mixing is protecting against backflow into the mixing port and secondary liquid, which can damage the system or cause the mixture to backflow into the mixing chamber and create system contamination. To prevent backflow, a check valve or other pneumatic, manual or electrical solenoid valves are often utilized. Particularly in applications where the space for the Venturi is limited, there may not be room for a check valve. The present invention alleviates the need for a check valve and permits use of a Venturi in spaces where it would not otherwise be feasible. It also permits a user to decide whether it wants to activate the Venturi to permit mixing of two liquids, gases and/or solids.

Another requirement of most Venturis is that an on/off valve be contained in the secondary fluid line, which then permits the user to determine whether to allow or prevent the flow of the secondary fluid. In the present invention, no such on/off valve is required as the movement of the Venturi is what allows or prevents the flow from the secondary fluid line. In some Venturi systems, a check valve is used in secondary fluid line. The moveable Venturi of the present system eliminates the need for such a check valve. The resulting reduction in components for the system allows for the use of the moveable Venturi in applications where a Venturi would not otherwise be feasible.

SUMMARY OF THE INVENTION

The present invention has been accomplished to provide a shuttling Venturi.

According to the present invention, there is provided a shuttling Venturi, which is generally comprised of a Venturi moveable in a linear or rotational motion, a mixing port and a mixing chamber.

In one aspect of the invention, it provides a shuttling Venturi that can be moved linearly or rotationally to allow or prevent the mixing of two different liquids, gases or solids.

In another aspect of the inventions, it provides a shuttling Venturi that eliminates the need for a check valve to prevent backflow.

In another aspect of the invention, it provides a shuttling Venturi that eliminates the need for an on/off valve to shut off flow from the secondary fluid line.

In another aspect of the invention, it provides a shuttling Venturi that can be moved linearly or rotationally to permit a user to combine water with a flavor without having to mix the water and flavor within a reservoir.

To the accomplishment of the above and related aspects, the invention may be embodied in the form illustrated in the accompanying drawings. The drawings, however, are illustrative only. Variations are contemplated as being part of the invention, limited only by the scope of the claims.

DETAILED DESCRIPTION OF THE INVENTION

Figure 1:
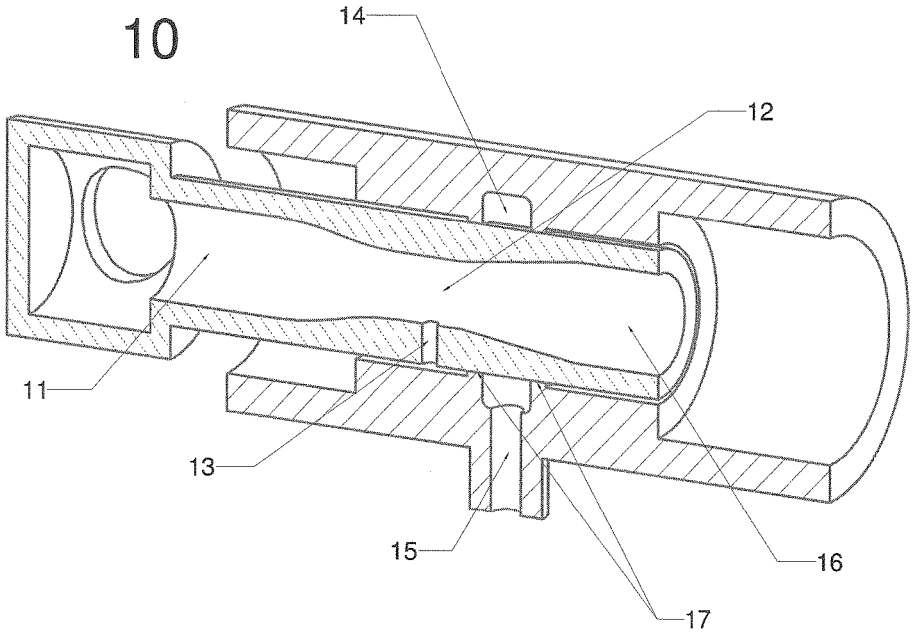
FIG. 1 is a perspective side view of the present invention.

As shown in the accompanying drawings, this is a shuttling Venturi. FIG. 1 shows an embodiment of a linear shuttling Venturi 10 that operates in a linear fashion. A liquid or gas enters Venturi inlet 11. The pressure of that liquid or gas decreases as it enters the constricted portion 12 of the Venturi. As shown in FIG. 1, the linear shuttling Venturi 10 is in an "off" position. In the off position, mixing port 13 is not aligned with 360 degree mixing chamber 14 and no liquid or gas is drawn from suction tube 15 to mix with the liquid or gas flowing through the constricted portion 12 of the Venturi. In this configuration, the liquid or gas that entered through Venturi inlet 11 flows out of Venturi outlet 16 without mixing with any other liquid or gas. Venturi body seals 17 also help ensure that no liquid or gas from suction tube 15 and mixing chamber 14 enters mixing port 13.

Figure 2:
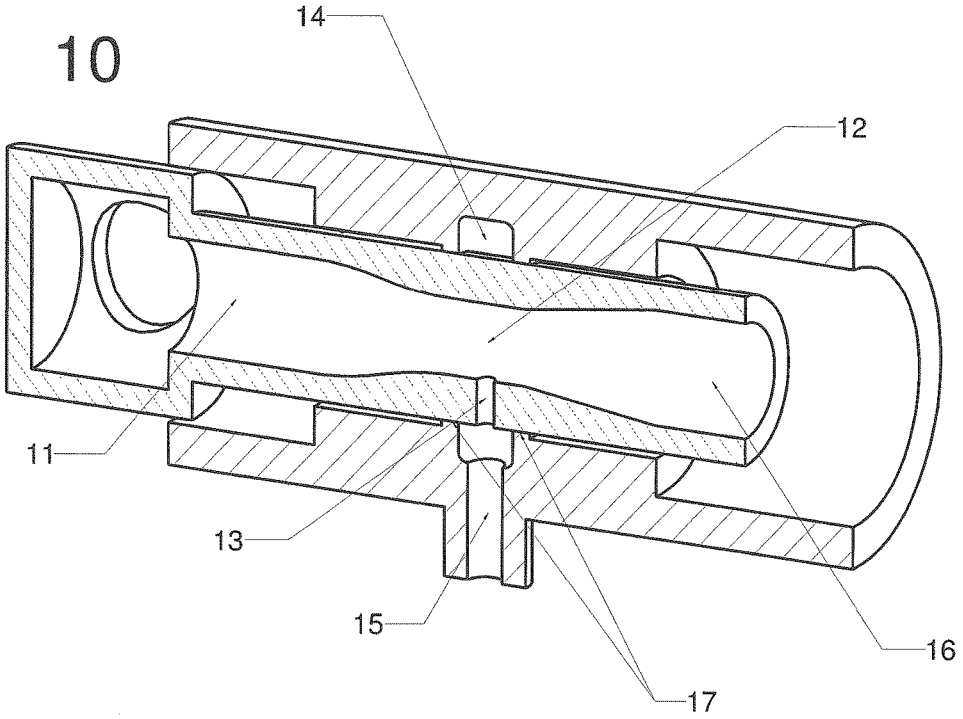
FIG. 2 is another perspective side view of the present invention.

FIG. 2 shows linear shuttling Venturi 10 in the "on" position. In this position, a liquid or gas enters Venturi inlet 11. The pressure of that liquid or gas decreases as it enters the constricted portion 12 of the Venturi. In the on position, mixing port 13 is aligned with 360 degree mixing chamber 14 and suction tube 15. The effect of the liquid or gas flowing through the Venturi causes the liquid or gas in suction tube 15 to be drawn into mixing chamber 14 and subsequently into the Venturi through mixing port 13, wherein the liquids and/or gases mix. In this configuration, the liquid or gas that entered through Venturi inlet 11 flows out of Venturi outlet 16 having mixed with the liquid or gas located in suction tube 15. Venturi body seals 17 restrict the liquid or gas coming from suction tube 15 to mixing chamber 14 so that it can flow through mixing port 13 to mix with the liquid or gas flowing through Venturi inlet 11 and constricted portion 12. Shuttling Venturi 10 is moved linearly into the on position when a force is applied to either end of shuttling Venturi 10. In some configurations, a spring holds shuttling Venturi 10 in an on or off position and only moves to the opposite position when a force is applied.

When the force is removed, shuttling Venturi 10 returns to the spring loaded position. Because the shuttling Venturi 10 can move between the on and off positions, no check valve is needed to prevent back flow into the mixing chamber. Additionally, no on/off valve is needed to shut off flow from suction tube 15.

Figure 3:
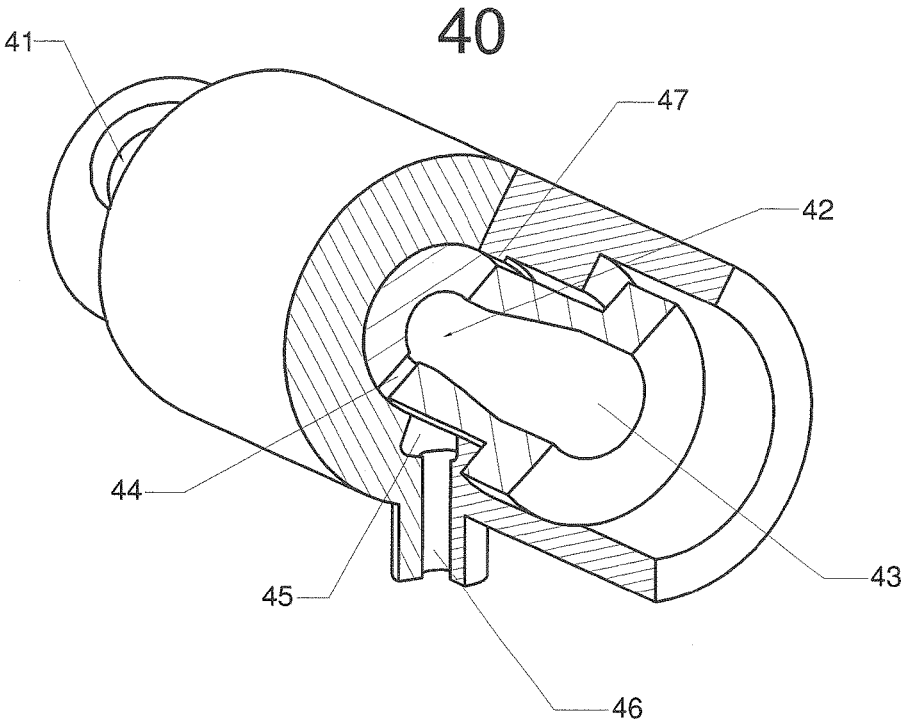
FIG. 3 is another perspective side view of the present invention.

FIG. 3 illustrates a rotational shuttling Venturi 40 in the "off" position. Rather than moving linearly, the Venturi in FIG. 3 moves rotationally. A liquid or gas enters through Venturi inlet 41 through constricted area 42 and out Venturi outlet 43. Mixing port 44 is not aligned with mixing chamber 45 and suction tube 46. As such no liquid or gas is drawn into constricted area 42 from suction tube 46 and mixing chamber 45 through mixing port 44. The liquid or gas that entered Venturi inlet 41 exits Venturi outlet 43 unchanged. Any leakage from suction tube 46 and mixing chamber 45 is prevented by sealing surface 47.

Figure 4:
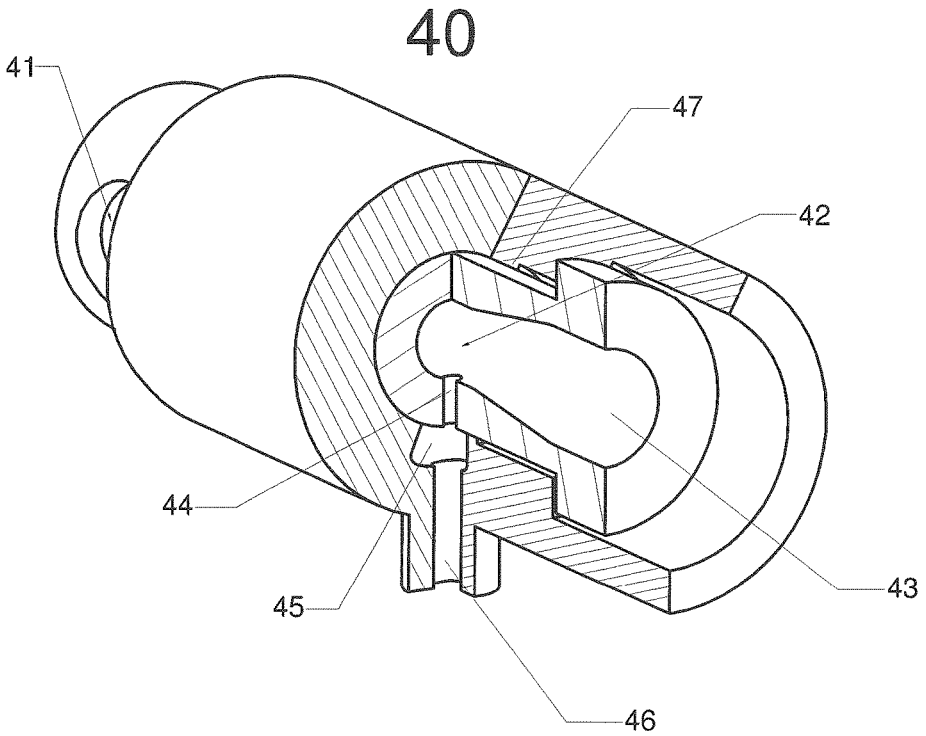
FIG. 4 is another perspective side view of the present invention.

In FIG. 4, a force has been applied to rotational shuttling Venturi 40 causing it to rotate into an "on" position so that mixing port 44 is aligned with mixing chamber 45 and suction tube 46. In the open position, a liquid or gas flows into Venturi inlet 41 to constricted area 42 where the pressure of the liquid or gas drops causing a liquid or gas in suction tube 46 and mixing chamber 45 to flow through mixing port 44 into the constricted area 42 where it mixes with the liquid or gas that entered from Venturi inlet 41 into constricted area 42. In this configuration, the liquid or gas that flows out of Venturi outlet 43 is a combination of the liquid or gas that entered through Venturi inlet 41 and the liquid or gas that entered through mixing port 44. Sealing surface 47 restricts the liquid or gas coming from suction tube 46 to mixing chamber 45 so that it can flow through mixing port 44 to mix with the liquid or gas flowing from Venturi inlet 41 into constricted portion 42. Because shuttling Venturi 40 can move between the on and off positions, no check valve is needed to prevent back flow into the mixing chamber 45. Additionally, no on/off valve is needed to shut off flow from suction tube 46.

Figure 5:
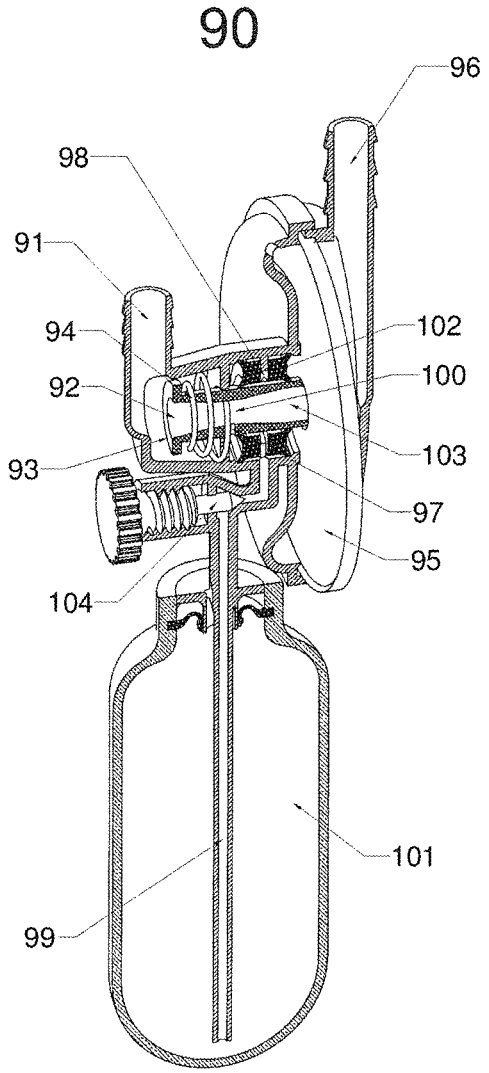
FIG. 5 is perspective cut away view of the present invention being used in a hydration pack application.

FIG. 5 shows the present invention being used in a hydration pack, which has minimal space for a Venturi. In FIG. 5, it is contemplated that a flavor cartridge 90 will be inserted in the suction line from a hydration pack to allow a user to add flavor to the water without mixing the flavor into the actual reservoir of the hydration pack. In flavor cartridge 90, a liquid flows through inlet manifold 91 into Venturi inlet 92. Shuttling Venturi 93 is maintained in an off position by return spring 94. When the user applies suction to outlet manifold 96, diaphragm 95 actuates due to the pressure differential of user suction and atmospheric pressure, exerting a force on shuttling Venturi 93 causing it to move to an on position so that mixing port 97 is aligned with mixing chamber 98 and suction tube 99. This allows for hands-free actuation of the system. As the liquid flows through constricted area 100, the liquid located in flavor reservoir 101 (often a liquid containing concentrated flavor essence) is drawn through suction tube 99 into mixing chamber 98, which is sealed off by lip ring seals 102, and then through mixing port 97 into constricted area 100, where the flavor essence mixes with the liquid flowing through shuttling Venturi 93. The mixed liquids then flow out of Venturi outlet 103 to outlet manifold 96 and from there to the user. Adjustable needle valve 104 allows the user to meter the amount of flavor essence that flows through suction tube 99 to mixing chamber 98.

Using the present invention as shown in FIG. 5 permits a user to combine water and a flavor hands-free without having to mix it within the hydration pack reservoir. It is extremely cumbersome to clean the reservoir of a hydration pack once anything other than water is introduced into the reservoir. The use of shuttling Venturi 93 in flavor cartridge 90 eliminates the need for mixing in the hydration pack reservoir and thus eliminates the cumbersome cleaning associated with such mixing.

The description of the invention above should not be interpreted as limiting the invention to the disclosed embodiment because those who are skilled in the art to which the invention relates will be able to devise other equivalent forms thereof within the scope of the invention. Variations and changes, which are obvious to one skilled in the art, are intended to be within the scope and nature of the present invention.

What is claimed is:

1. A shuttling Venturi, comprising:

a Venturi, moveable in a linear motion, wherein said motion is achieved by application of a force;

a mixing chamber;

a mixing port non-parallel with the Venturi, wherein the mixing port is axial misaligned with the mixing chamber when the Venturi is in a first configuration;

a suction tube extending from the mixing port to a reservoir;

a needle valve extending into the suction tube, wherein the needle valve is actuatable allowing regulation of a first fluid through the suction tube; and an outlet manifold, wherein suction on the outlet manifold actuates the Venturi from the first configuration.

2. The shuttling Venturi of claim 1, wherein said mixing port is substantially perpendicular to the Venturi.

3. The shuttling Venturi of claim 1, wherein said mixing port becomes axially aligned with said mixing chamber, in a second configuration, when said Venturi is moved linearly in a direction non-parallel with the mixing port.

4. The shuttling Venturi of claim 3, wherein the movement of said Venturi from a first configuration to a second configuration allows mixing of the first fluid with at least one additional fluid.

5. A shuttling Venturi, comprising:

a Venturi, moveable in an axial linear motion, wherein said motion is achieved by application of a suction force;

a mixing chamber;

a mixing port in the Venturi, wherein said mixing port is axially misaligned with said mixing chamber and wherein the mixing port and mixing chamber are non-parallel to the Venturi; and a spring axially aligned with the Venturi, wherein the spring is in an extended configuration when the Venturi is in a first configuration;

a suction tube extending from the mixing port to a reservoir;

a needle valve extending into the suction tube, wherein the needle valve is actuatable allowing regulation of a first fluid through the suction tube; and an outlet manifold, wherein suction on the outlet manifold actuates the Venturi from the first configuration.

6. The shuttling Venturi of claim 5, wherein said mixing port is substantially perpendicular to the Venturi.

7. The shuttling Venturi of claim 5, wherein said mixing port becomes axially aligned with said mixing chamber when said Venturi is moved in a first linear direction to a second configuration thereby at least partially positioning the spring in a contracted configuration.

8. The shuttling Venturi of claim 7, wherein the movement of said Venturi from a first configuration to a second configuration allows mixing of two or more fluids.

9. A shuttling Venturi, comprising: a Venturi, moveable in an axial rotational motion, wherein said motion is achieved by application of a rotational force; a mixing chamber; and a sole mixing port non-parallel with the Venturi, wherein said mixing port is axially misaligned with said mixing chamber when said Venturi is in a first configuration;

a suction tube extending from the mixing port to a reservoir;

a needle valve extending into the suction tube, wherein the needle valve is actuatable allowing regulation of a first fluid through the suction tube; and an outlet manifold, wherein suction on the outlet manifold actuates the Venturi from the first configuration.

10. The shuttling Venturi of claim 9, wherein said mixing port is substantially perpendicular to the Venturi.

11. The shuttling Venturi of claim 9, wherein said mixing port becomes aligned with said mixing chamber, in a second configuration, when said Venturi is moved rotationally.

12. The shuttling Venturi of claim 11, wherein the movement of said Venturi from a first configuration to a second configuration allows mixing of the first fluid with at least one additional fluids.

* * * * *